US010716328B2

(12) United States Patent
Liu et al.

(10) Patent No.: US 10,716,328 B2
(45) Date of Patent: Jul. 21, 2020

(54) ELECTRONIC CIGARETTE ATOMIZER

(71) Applicant: CHINA TOBACCO HUNAN INDUSTRIAL CO., LTD., Changsha, Hunan (CN)

(72) Inventors: Jianfu Liu, Hunan (CN); Kejun Zhong, Hunan (CN); Xiaoyi Guo, Hunan (CN); Wei Huang, Hunan (CN); Yuangang Dai, Hunan (CN); Xinqiang Yin, Hunan (CN); Hong Yu, Hunan (CN); Jianhua Yi, Hunan (CN); Yongquan Zhou, Hunan (CN)

(73) Assignee: China Tobacco Hunan Industrial Co., Ltd., Changsha, Hunan (CN)

( * ) Notice: Subject to any disclaimer, the term of this patent is extended or adjusted under 35 U.S.C. 154(b) by 192 days.

(21) Appl. No.: 15/762,046

(22) PCT Filed: Jun. 22, 2016

(86) PCT No.: PCT/CN2016/086698
§ 371 (c)(1),
(2) Date: Mar. 21, 2018

(87) PCT Pub. No.: WO2017/197704
PCT Pub. Date: Nov. 23, 2017

(65) Prior Publication Data

US 2018/0271148 A1 Sep. 27, 2018

(30) Foreign Application Priority Data

May 16, 2016 (CN) ..... 2016 1 03233290

(51) Int. Cl.
*A24F 47/00* (2020.01)
*B05B 17/06* (2006.01)

(52) U.S. Cl.
CPC ..... *A24F 47/002* (2013.01); *A24F 47/00* (2013.01); *A24F 47/008* (2013.01); *B05B 17/06* (2013.01)

(58) Field of Classification Search
CPC .. A24F 47/00–008; A24F 40/00; A24F 40/10; A24F 40/46; B05B 17/06
See application file for complete search history.

(56) References Cited

FOREIGN PATENT DOCUMENTS

CN 203692553 U 7/2014
CN 204015104 U 12/2014
(Continued)

OTHER PUBLICATIONS

International Search Report issued in International Application No. PCT/CN2016/086698 dated Feb. 13, 2017, 6 pages.

*Primary Examiner* — Michael H. Wilson
*Assistant Examiner* — Yana B Krinker
(74) *Attorney, Agent, or Firm* — Mauriel Kapouytian Woods LLP; Liang Huang; Michael Mauriel

(57) ABSTRACT

Embodiments of the present invention disclose an electronic cigarette atomizer, including an outer sleeve and a suction nozzle connected with one end of the outer sleeve, wherein a tobacco tar cavity and an atomization core are provided in the outer sleeve; the atomization core comprises two ultrasonic atomization components, and atomization surfaces of the two ultrasonic atomization components are provided oppositely; a gap is provided between the two atomization surfaces; the gap communicates with the suction nozzle; the two atomization surfaces are in contact with a first tobacco tar storage body and a second tobacco tar storage body respectively; and both of the first tobacco tar storage body and the second tobacco tar storage body communicate with the tobacco tar cavity.

14 Claims, 5 Drawing Sheets

(56) References Cited

FOREIGN PATENT DOCUMENTS

| | | | |
|---|---|---|---|
| CN | 104287098 | A | 1/2015 |
| CN | 204169066 | U | 2/2015 |
| CN | 204191592 | U | 3/2015 |
| CN | 105054309 | A | 11/2015 |
| WO | 2016059000 | A1 | 4/2016 |

ELECTRONIC CIGARETTE ATOMIZER

CROSS REFERENCE TO RELATED APPLICATIONS

This application is a national phase application of international application number PCT/CN2016/086698 filed on Jun. 22, 2016, which claims priority to Chinese application number 2016103233290 filed on May 16, 2016. The entire contents of these applications are hereby incorporated herein by reference.

TECHNICAL FIELD

The present invention relates to an electronic cigarette atomizer.

BACKGROUND ART

The existing electronic cigarette atomizers generally adopt heating wires to heat tobacco tar in tobacco tar storage cotton, the temperatures of the heating wires are relatively high in a heating process, so the heating wires are scorched easily to produce burnt flavor, moreover the high temperatures produced by the heating wires are transferred to outer walls of the atomizers easily, so that the electronic cigarette becomes hot, the energy efficiency is low, the smoking taste is poor, and meanwhile the atomizers are prone to tobacco tar leakage.

CONTENTS OF INVENTION

The technical problem to be solved in the present invention is to provide an electronic cigarette atomizer in view of the shortcomings of the prior art.

To solve the above technical problem, the present invention adopts the technical solutions as follows: an electronic cigarette atomizer comprises an outer sleeve and a suction nozzle connected with one end of the outer sleeve; a tobacco tar cavity and an atomization core are provided in the outer sleeve; the atomization core comprises a first ultrasonic atomization component and a second ultrasonic atomization component which are provided oppositely; a gap is provided between the first ultrasonic atomization component and the second ultrasonic atomization component, so that steam fog atomized by the first ultrasonic atomization component and the second ultrasonic atomization component is atomized by the corresponding first ultrasonic atomization component or the second ultrasonic atomization component again, thereby solving the problem that the smoking taste is affected by large particles of the steam fog; the gap communicates with the suction nozzle; the first ultrasonic atomization component and the second ultrasonic atomization component are respectively in contact with a first tobacco tar storage body and a second tobacco tar storage body; and both of the first tobacco tar storage body and the second tobacco tar storage body communicate with the tobacco tar cavity.

One surface of the first ultrasonic atomization component is a first atomization surface, one surface of the second ultrasonic atomization component is a second atomization surface, the first atomization surface and the second atomization surface are provided oppositely, and the gap for communicating the first atomization surface with the second atomization surface is provided between the first atomization surface and the second atomization surface, so that airflow can take away the smoke through the gap.

One end of the first tobacco tar storage body is covered on the first atomization surface, and the other end communicates with the tobacco tar cavity; one end of the second tobacco tar storage body is covered on the second atomization surface, and the other end communicates with the tobacco tar cavity, so that the first tobacco tar storage body and the second tobacco tar storage body can guide the liquid in the tobacco tar cavity onto the first atomization surface and the second atomization surface.

Both of the first ultrasonic atomization component and the second ultrasonic atomization component together with the outer sleeve are provided to extend along the longitudinal direction of the ultrasonic atomizer, so that when the ultrasonic atomizer is vertically placed, the first ultrasonic atomization component and the second ultrasonic atomization component are in vertical states, and one end of the liquid storage body which is away from the suction nozzle communicates with the tobacco tar cavity. The tobacco tar permeates onto the entire liquid storage body from the bottom of the liquid storage body, since the tobacco tar permeates in the reverse direction to that of the gravity, excessive tobacco tar will not be accumulated on the atomization surfaces, and thus the problems of slow start of the atomizer and small smoke volume can be effectively solved.

Both of the first ultrasonic atomization component and the second ultrasonic atomization component are provided to extend along the longitudinal direction of the outer sleeve, so that when the ultrasonic atomizer is vertically placed, the piezoelectric ceramic piece is in the vertical state.

In a preferred solution of the present invention, the atomization core and the tobacco tar cavity are provided side by side.

The first ultrasonic atomization component comprises a first piezoelectric ceramic piece and a first bracket; a first mounting hole for accommodating the first piezoelectric ceramic piece and the first tobacco tar storage body is provided in the first bracket; a second mounting hole which is below the mounting hole is provided in the first bracket; a tobacco tar guide body penetrates through the second mounting hole and is fixed in the second mounting hole; and one side of the first tobacco tar storage body which is close to the second mounting hole is in contact with the tobacco tar guide body.

One surface of the first piezoelectric ceramic piece which is in contact with the first tobacco tar storage body is the first atomization surface. The tobacco tar guide body is fixed in a silica gel sleeve, the silica gel sleeve penetrates through the second mounting hole to be fixed in the second mounting hole, and the silica gel sleeve can guarantee better stability of the tobacco tar guide body. The second ultrasonic atomization component comprises a second piezoelectric ceramic piece and a second bracket; an accommodation cavity for installation of the second piezoelectric ceramic piece is provided on the second bracket; one surface of the second piezoelectric ceramic piece which is opposite to the first piezoelectric ceramic piece is in contact with the second tobacco tar storage body; and a salient is provided on the second tobacco tar storage body, and the salient is in contact with one end of the tobacco tar guide body extending out of the second mounting hole. One surface of the second piezoelectric ceramic piece which is in contact with the second tobacco tar storage body is the second atomization surface. Therefore, the first atomization surface and the second atomization surface are provided oppositely, the airflow takes away the smoke through a gap between one surface of the first tobacco tar storage body deviating from the first atomization surface and one surface of the second tobacco tar storage body deviating from the second atomization surface, and thus the volume and the taste of the smoke are effectively improved.

In another embodiment of the present invention, the atomization core is provided in a cavity body of the tobacco tar cavity.

The first ultrasonic atomization component comprises the first piezoelectric ceramic piece and a first elastic pad; the first piezoelectric ceramic piece props against the inner wall of the cavity body through the first elastic pad; the second ultrasonic atomization component comprises the second piezoelectric ceramic piece; and the second piezoelectric ceramic piece props against the inner wall of the cavity body through a second elastic pad. Thus, the first piezoelectric ceramic piece and the second piezoelectric ceramic piece can be detached conveniently their working lives can be prolonged.

A first through hole is provided in the middle of the first elastic pad; a second through hole is provided in the middle of the second elastic pad; the first through hole and the second through hole are located between the first piezoelectric ceramic piece and the second piezoelectric ceramic piece, so that the first atomization surface communicates with the second atomization surface.

An observation window is provided in the outer sleeve outside the tobacco tar cavity to conveniently observe whether tobacco tar needs to be added.

Compared with the prior art, the present invention has the following beneficial effects: the present invention has simple structure and atomizes the tobacco tar and other liquid using the ultrasonic principle to effectively solve the problem that the existing electronic cigarette produces burnt flavor easily and has poor taste; the atomization surfaces of the two ultrasonic atomization components are provided oppositely, the two ultrasonic atomization components eject smoke to each other in a working process, so that the large-particle smoke is absorbed and atomized again by the tobacco tar storage bodies on the atomization surfaces; as the airflow passes by the gap between the two ultrasonic atomization components, the small particle smoke is directly taken away by the airflow, the amount of the smoke can be increased, and the smoking taste can also be improved; the energy efficiency is high; as the piezoelectric ceramic pieces are vertically provided in the outer sleeve of the atomizer, the problems of slow start of the piezoelectric ceramic pieces and small amount of smoke resulting from the accumulation of excessive liquid on the atomization surfaces of the piezoelectric ceramic pieces can be effectively prevented, and moreover the problem that the existing electronic cigarette atomizer is prone to tobacco tar leakage is solved.

SPECIFIC MODE FOR CARRYING OUT THE INVENTION

Figure 1:
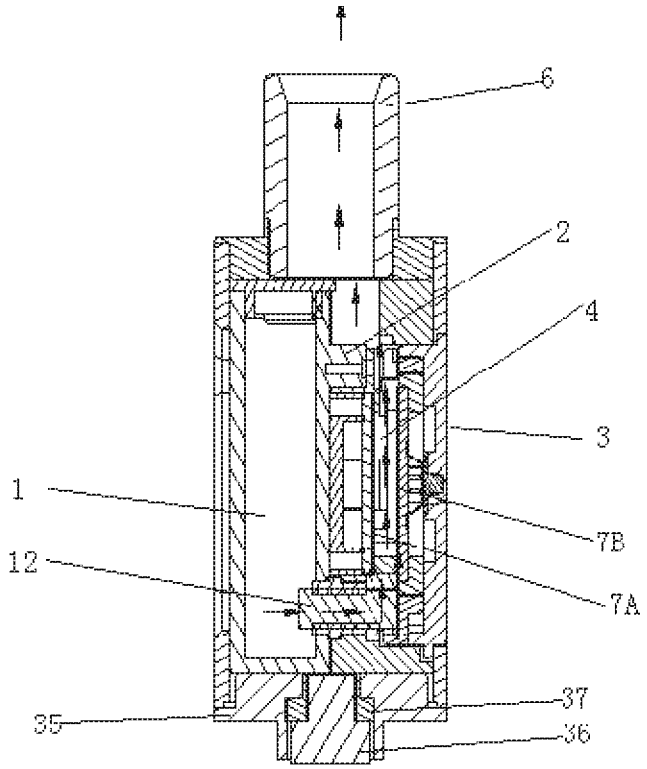
FIG. 1 is a structural schematic diagram of embodiment 1 of the present invention.

As shown in FIG. 1, an atomizer in embodiment 1 of the present invention comprises an outer sleeve 3 and a suction nozzle 6 connected with one end of the outer sleeve 3; a tobacco tar cavity 1 and an atomization core 2 are provided in the outer sleeve 3; the atomization core 2 comprises a first ultrasonic atomization component and a second ultrasonic atomization component which are provided oppositely; a gap 4 is provided between the first ultrasonic atomization component and the second ultrasonic atomization component; the gap 4 communicates with the suction nozzle 6; the first ultrasonic atomization component and the second ultrasonic atomization component are respectively in contact with a first tobacco tar storage body 7A and a second tobacco tar storage body 7B; and both of the first tobacco tar storage body 7A and the second tobacco tar storage body 7B communicate with the tobacco tar cavity 1.

One surface of the first ultrasonic atomization component is a first atomization surface, one surface of the second ultrasonic atomization component is a second atomization surface, the first atomization surface and the second atomization surface are provided oppositely, and the gap 4 for communicating the first atomization surface with the second atomization surface is provided between the first atomization surface and the second atomization surface.

One end of the first tobacco tar storage body 7A is covered on the first atomization surface, and the other end communicates with the tobacco tar cavity 1; one end of the second tobacco tar storage body 7B is covered on the second atomization surface, and the other end communicates with the tobacco tar cavity 1, so that the first tobacco tar storage body 7A and the second tobacco tar storage body 7B guide the liquid in the tobacco tar cavity 1 onto the first atomization surface and the second atomization surface.

Figure 2:
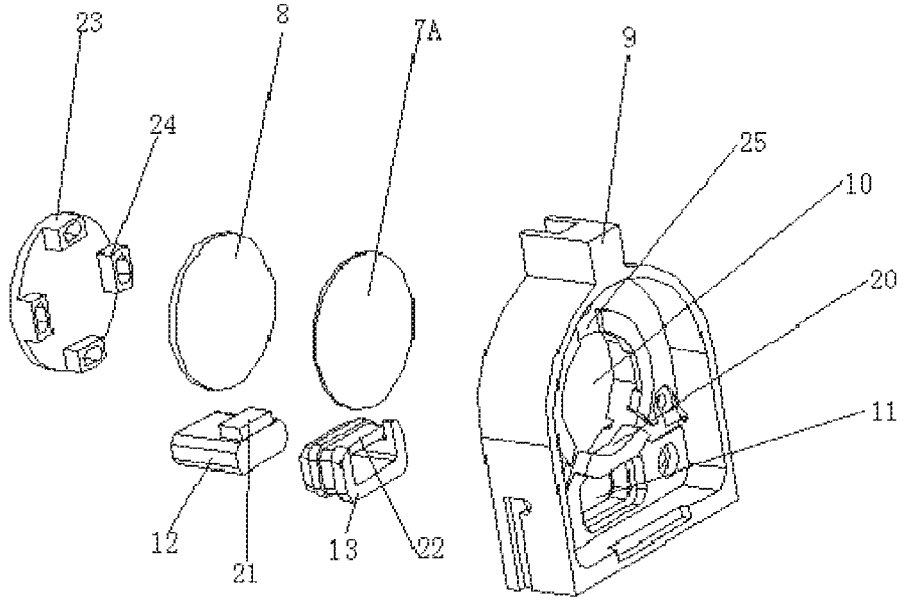
FIG. 2 is an explosive view of a first ultrasonic atomization component in embodiment 1 of the present invention.

As shown in FIG. 2, in the embodiment 1, the first ultrasonic atomization component comprises a first piezoelectric ceramic piece 8 and a first bracket 9; a first mounting hole 10 for accommodating the first piezoelectric ceramic piece 8 and the first tobacco tar storage body 7A is provided in the first bracket 9; a second mounting hole 11 which is below the mounting hole 10 is provided in the first bracket 9; a silica gel sleeve 13 is fixed in the second mounting hole 11, and a tobacco tar guide body 12 is installed in the silica gel sleeve 13; and one side of the first tobacco tar storage body 7A which is close to the second mounting hole 11 is in contact with the tobacco tar guide body 12.

The tobacco tar guide body can be a tobacco tar guide rope for buffering the tobacco tar and preventing the tobacco tar accumulation or tobacco tar leakage caused by too high tobacco tar guide speed, and the smoke atomized by the atomization surfaces is directly taken away, thereby avoiding the poor taste of the smoke caused by the accumulation of the smoke.

As shown in FIG. 2, a communication opening 20 is provided between the first mounting hole 10 and the second mounting hole 11, a salient 21 is provided on the tobacco tar guide body 12, a through hole 22 which has matched size and shape with that of the salient 21 is provided in the silica gel sleeve 13, and during installation, the salient 21 passes through the through hole 22 and is embedded in the communication opening 20 and is in contact with the first tobacco tar storage body 7A.

To fasten the first piezoelectric ceramic piece 8, a first elastic pad 23 is installed on the first bracket 9; a salient 24 is provided on the first elastic pad 23, and during installation, the salient 24 is embedded in an installation opening 25 of the first bracket 9. The first elastic pad can also prevent the deformation of the first piezoelectric ceramic piece 8 and can play a very good buffering role.

Figure 3:
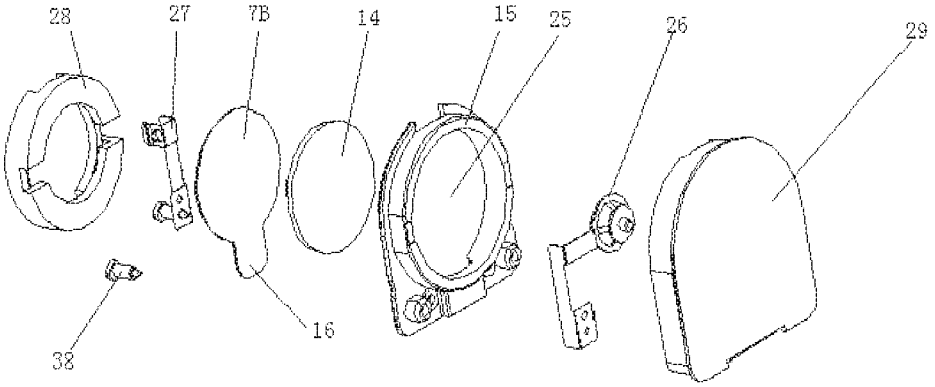
FIG. 3 is an explosive view of a second ultrasonic atomization component in embodiment 1 of the present invention.

As shown in FIG. 3, the second ultrasonic atomization component comprises a second piezoelectric ceramic piece 14 and a second bracket 15; an accommodation cavity 25 for installation of the second piezoelectric ceramic piece 14 is provided on the second bracket 15; one surface of the second piezoelectric ceramic piece 14 which is opposite to the first piezoelectric ceramic piece 8 is attached to the second tobacco tar storage body 7B; and a salient 16 is provided on the second tobacco tar storage body 7B, and the salient 16 is in contact with one end of the tobacco tar guide body 12 extending out of the second mounting hole 11.

A positive electrode 26 and a negative electrode 27 are used for driving vibration of the piezoelectric ceramic pieces.

To make the structure of the second ultrasonic atomizer to be more stable, the second piezoelectric ceramic piece 14 is pressed tightly on the second bracket 15 by a second elastic pad 28, and one side of the second bracket 15 which is away from the second elastic pad 28 is connected with a side cover 29.

Figure 4:
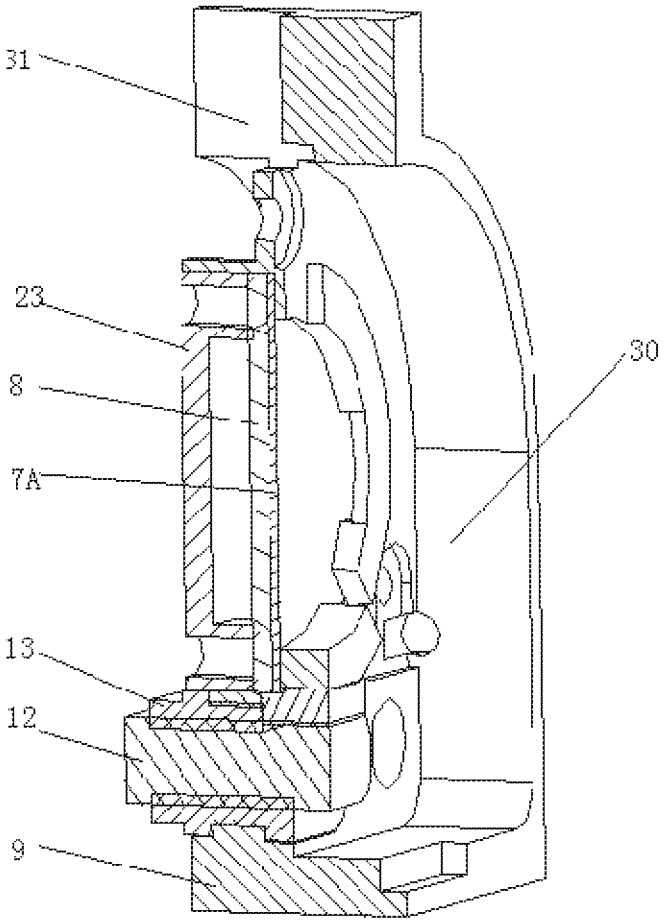
FIG. 4 is a schematic diagram of an installation structure of the second ultrasonic atomization component in embodiment 1 of the present invention.

As shown in FIG. 4, a cavity body 30 for accommodating the second ultrasonic atomization component is provided in the first bracket 9, so that the second ultrasonic atomization component can be replaced and detached conveniently; and one end of the first bracket 9 which is close to the suction nozzle 6 is provided with a smoke passage 31 communicating with the gap 4, and the smoke passage communicates with the inner cavity of the suction nozzle 6.

Figure 5:
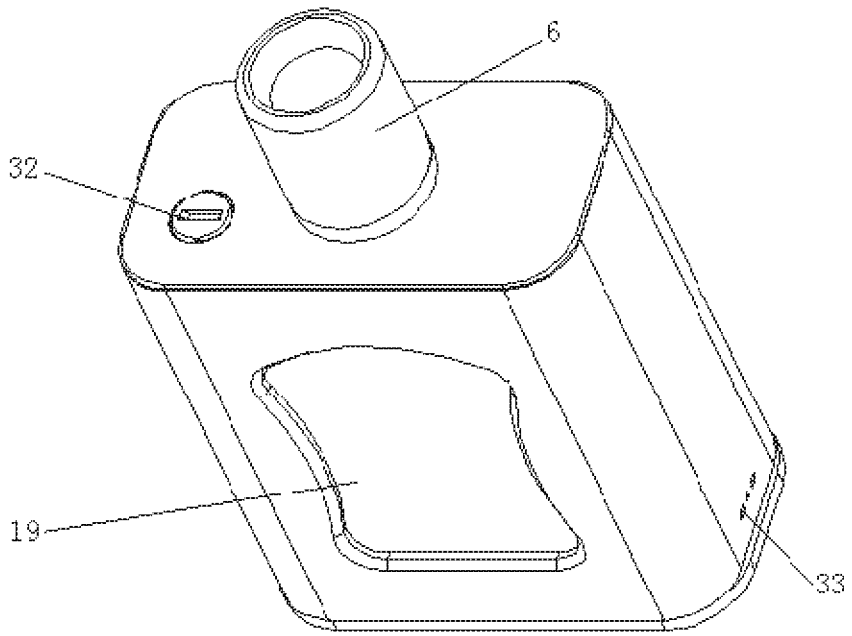
FIG. 5 is a schematic diagram of an external structure of an atomizer in embodiment 1 of the present invention.

As shown in FIG. 5, in the atomizer of the embodiment 1, an observation window 19 is provided in the outer sleeve to facilitate observation of the condition of the tobacco tar storage in the tobacco tar cavity 1. A tobacco tar injection plug 32 is provided at the end part of the outer sleeve 3 which is close to the suction nozzle, and tobacco tar can be added into the tobacco tar cavity 1 after the tobacco tar injection plug is opened. An air inlet hole 33 is provided in the side of the outer sleeve 3, and the air inlet hole 33 communicates with the gap 4.

Figure 6:
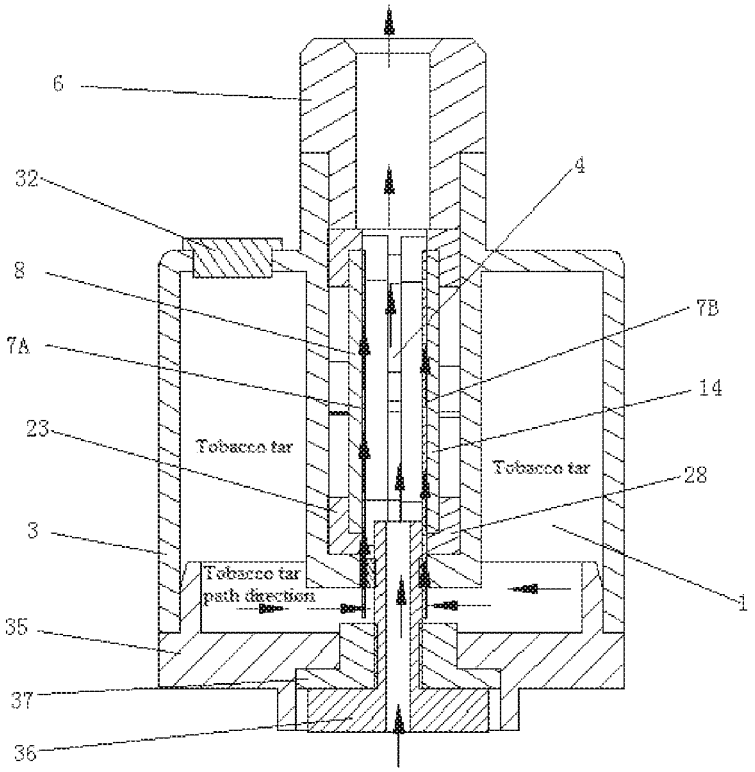
FIG. 6 is a structural schematic diagram of embodiment 2 of the present invention.
Figure 7:
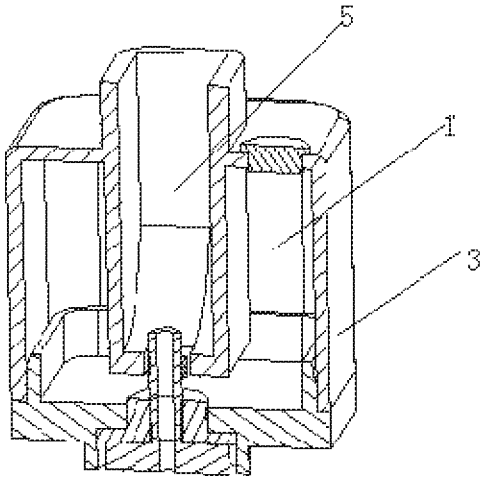
FIG. 7 is a structural schematic diagram of a tobacco tar cavity and a suction nozzle in embodiment 2 of the present invention.

As shown in FIG. 6 and FIG. 7, the atomizer in embodiment 2 of the present invention comprises the outer sleeve 3, the tobacco tar cavity 1 is provided in the outer sleeve 3, a cavity body 5 is provided at the middle of the tobacco tar cavity 1, and the cavity body 5 is used for fixing the first ultrasonic atomization component and the second ultrasonic atomization component. The top end of the cavity body 5 extends out of the outer sleeve 3 and is connected with the suction nozzle 6, and the cavity body 5 communicates with the inner cavity of the suction nozzle 6.

Figure 8:
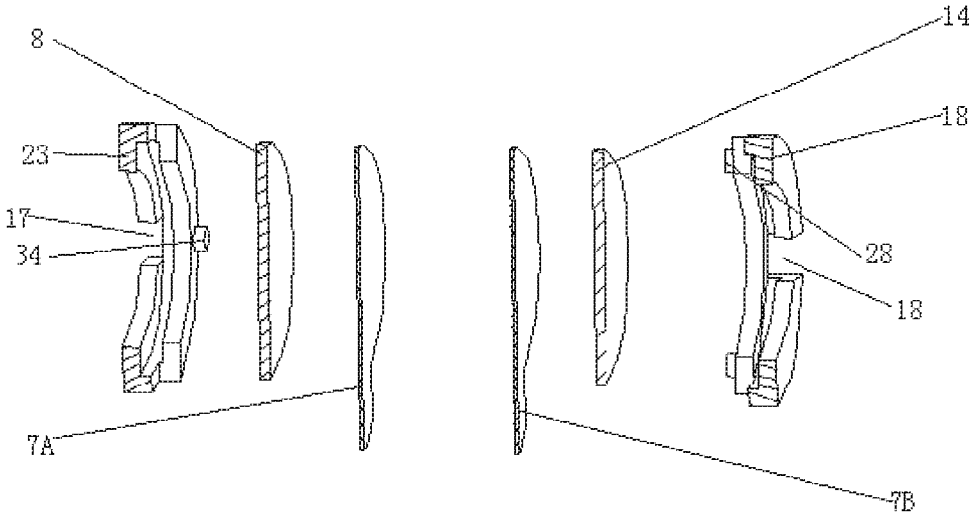
FIG. 8 is an explosive view of an ultrasonic atomization component in embodiment 2 of the present invention.

As shown in FIG. 8, the first ultrasonic atomization component comprises the first piezoelectric ceramic piece 8; the first piezoelectric ceramic piece 8 is in fixed connection with the inner wall of the cavity body 5 through the first elastic pad 23; the second ultrasonic atomization component comprises the second piezoelectric ceramic piece 14; and the second piezoelectric ceramic piece 14 is in fixed connection with the inner wall of the cavity body 5 through the second elastic pad 28. The tobacco tar injection plug 32 is provided at the end part of the outer sleeve 3 which is close to the suction nozzle, and tobacco tar can be added into the tobacco tar cavity 1 after the tobacco tar injection plug is opened.

As shown in FIG. 8, elastic columns 34 are provided on both of the first elastic pad 23 and the second elastic pad 28, and when the two piezoelectric ceramic pieces are respectively attached to the corresponding elastic pads, the elastic columns can prevent that the smoking effect is affected because the smoke passage is blocked resulting from the gapless attachment between the piezoelectric ceramic pieces and the elastic pads.

A first through hole 17 is provided in the middle of the first elastic pad 23; a second through hole 18 is provided in the middle of the second elastic pad 28; the first through hole 17 and the second through hole 18 are located between the first piezoelectric ceramic piece 8 and the second piezoelectric ceramic piece 14, and the first through hole 17 and the second through hole 18 communicate the first atomization surface with the second atomization surface.

As shown in FIG. 7, one end of the outer sleeve 3 which is away from the suction nozzle 6 is sealed by a bottom cover 35, an electrode 36 is fixed to the bottom cover 35, the electrode 36 is insulated from the bottom cover 35 through an insulation ring 37, and one end of the electrode 36 extends into the cavity body 5. The atomization surfaces of the present invention refer to surfaces (i.e., surfaces that can eject atomized gas) of the piezoelectric ceramic pieces which is in contact with the liquid storage body.

The atomization surfaces of the two piezoelectric ceramic atomization pieces are provided oppositely, when one piezoelectric ceramic atomization piece produces smoke molecules with larger particle sizes after atomization, the smoke molecules can be ejected onto the surface of the other piezoelectric ceramic atomization piece and atomized again, so that the smoke molecules with larger particle sizes are changed into smoke molecules with smaller particle sizes, and thus the taste of the smoke is more smooth.

The invention claimed is:

1. An electronic cigarette atomizer, wherein the electronic cigarette atomizer comprises an outer sleeve and a suction nozzle connected with one end of the outer sleeve; a tobacco tar cavity and an atomization core are provided in the outer sleeve; the atomization core comprises a first ultrasonic atomization component and a second ultrasonic atomization component which are provided oppositely; a gap is provided between the first ultrasonic atomization component and the second ultrasonic atomization component; the gap communicates with the suction nozzle; the first ultrasonic atomization component and the second ultrasonic atomization component are respectively in contact with a first tobacco tar storage body and a second tobacco tar storage body; and both of the first tobacco tar storage body and the second tobacco tar storage body communicate with the tobacco tar cavity, wherein one surface of the first ultrasonic atomization component is a first atomization surface, one surface of the second ultrasonic atomization component is a second atomization surface, the first atomization surface and the second atomization surface are provided oppositely, and the gap communicates the first atomization surface with the second atomization surface.

2. The electronic cigarette atomizer of claim 1, wherein one end of the first tobacco tar storage body is provided on the first atomization surface, and the other end communicates with the tobacco tar cavity; one end of the second tobacco tar storage body is provided on the second atomization surface, and the other end communicates with the tobacco tar cavity.

3. The electronic cigarette atomizer of claim 2, wherein both of the first ultrasonic atomization component and the second ultrasonic atomization component are provided to extend along the longitudinal direction of the outer sleeve.

4. The electronic cigarette atomizer of claim 3, wherein one end of the liquid storage body which is away from the suction nozzle communicates with the tobacco tar cavity.

5. The electronic cigarette atomizer of claim 1, wherein the atomization core and the tobacco tar cavity are provided side by side.

6. The electronic cigarette atomizer of claim 5, wherein the atomization core is provided in a cavity body of the tobacco tar cavity.

7. An electronic cigarette atomizer, wherein the electronic cigarette atomizer comprises an outer sleeve and a suction nozzle connected with one end of the outer sleeve; a tobacco tar cavity and an atomization core are provided in the outer sleeve; the atomization core comprises a first ultrasonic atomization component and a second ultrasonic atomization component which are provided oppositely; a gap is provided between the first ultrasonic atomization component and the second ultrasonic atomization component; the gap communicates with the suction nozzle; the first ultrasonic atomization component and the second ultrasonic atomization component are respectively in contact with a first tobacco tar storage body and a second tobacco tar storage body; and both of the first tobacco tar storage body and the second tobacco tar storage body communicate with the tobacco tar cavity, wherein the atomization core and the tobacco tar cavity are provided side by side, and, wherein the first ultrasonic atomization component comprises a first piezoelectric ceramic piece and a first bracket; a first mounting hole for accommodating the first piezoelectric ceramic piece and the first tobacco tar storage body is provided in the first bracket; a second mounting hole which is below the first mounting hole is provided in the first bracket; a tobacco tar guide body penetrates through the second mounting hole and is fixed in the second mounting hole; and one side of the first tobacco tar storage body which is close to the second mounting hole is in contact with the tobacco tar guide body.

8. The electronic cigarette atomizer of claim 7, wherein one surface of the first piezoelectric ceramic piece which is in contact with the first tobacco tar storage body is the first atomization surface.

9. The electronic cigarette atomizer of claim 8, wherein the tobacco tar guide body is fixed in a silica gel sleeve, and the silica gel sleeve penetrates through the second mounting hole and is fixed in the second mounting hole.

10. The electronic cigarette atomizer of claim 7, wherein the second ultrasonic atomization component comprises a second piezoelectric ceramic piece and a second bracket; an accommodation cavity for installation of the second piezoelectric ceramic piece is provided on the second bracket; one surface of the second piezoelectric ceramic piece which is opposite to the first piezoelectric ceramic piece is in contact with the second tobacco tar storage body; and a salient is provided on the second tobacco tar storage body, and the salient is in contact with one end of the tobacco tar guide body extending out of the second mounting hole.

11. The electronic cigarette atomizer of claim 10, wherein one surface of the second piezoelectric ceramic piece which is in contact with the second tobacco tar storage body is the second atomization surface.

12. The electronic cigarette atomizer of claim 7, wherein an observation window is provided in the outer sleeve outside the tobacco tar cavity.

13. An electronic cigarette atomizer, wherein the electronic cigarette atomizer comprises an outer sleeve and a suction nozzle connected with one end of the outer sleeve; a tobacco tar cavity and an atomization core are provided in the outer sleeve; the atomization core comprises a first ultrasonic atomization component and a second ultrasonic atomization component which are provided oppositely; a gap is provided between the first ultrasonic atomization component and the second ultrasonic atomization component; the gap communicates with the suction nozzle; the first ultrasonic atomization component and the second ultrasonic atomization component are respectively in contact with a first tobacco tar storage body and a second tobacco tar storage body; and both of the first tobacco tar storage body and the second tobacco tar storage body communicate with the tobacco tar cavity, wherein the atomization core and the tobacco tar cavity are provided side by side, wherein the atomization core is provided in a cavity body of the tobacco tar cavity, and wherein the first ultrasonic atomization component comprises the first piezoelectric ceramic piece and a first elastic pad; the first piezoelectric ceramic piece props against the inner wall of the cavity body through the first elastic pad; the second ultrasonic atomization component comprises the second piezoelectric ceramic piece and a second elastic pad; and the second piezoelectric ceramic piece props against the inner wall of the cavity body through the second elastic pad.

14. The electronic cigarette atomizer of claim 13, wherein a first through hole is provided in the middle of the first elastic pad; a second through hole is provided in the middle of the second elastic pad; the first through hole and the second through hole are located between the first piezoelectric ceramic piece and the second piezoelectric ceramic piece, and the first atomization surface communicates with the second atomization surface through the first through hole and the second through hole.

* * * * *